US006382933B1

(12) United States Patent
Anderson

(10) Patent No.: US 6,382,933 B1
(45) Date of Patent: May 7, 2002

(54) BLADDER PUMP FOR LIQUID SAMPLING AND COLLECTING

(76) Inventor: Brian M. Anderson, 7353 Cedar Crest Dr., Sauk City, WI (US) 53583

( * ) Notice: Subject to any disclaimer, the term of this patent is extended or adjusted under 35 U.S.C. 154(b) by 0 days.

(21) Appl. No.: 09/512,295

(22) Filed: Feb. 24, 2000

(51) Int. Cl.[7] ..... F04B 43/08
(52) U.S. Cl. ..... 417/394; 417/478
(58) Field of Search ..... 417/394, 478; 137/533

(56) References Cited

U.S. PATENT DOCUMENTS

| | | | | | |
|---|---|---|---|---|---|
| 1,043,279 | A | * | 11/1912 | Wheeler | 137/533 |
| 1,352,306 | A | * | 9/1920 | Mott | 417/478 |
| 1,976,415 | A | * | 10/1934 | Scott | 417/478 |
| 2,046,491 | A | * | 7/1936 | Scott | 417/478 |
| 2,196,993 | A | * | 4/1940 | Kidder | 417/394 |
| 2,626,569 | A | * | 1/1953 | Knudson | 417/394 |
| 4,008,008 | A | | 2/1977 | Vergnet | 417/385 |
| 4,111,613 | A | | 9/1978 | Spemy | 417/394 |
| 4,585,060 | A | | 4/1986 | Bernardin et al. | 166/64 |
| 4,674,959 | A | | 6/1987 | Fox et al. | 417/244 |
| 4,701,107 | A | * | 10/1987 | Dickinson et al. | 417/478 |
| 4,810,172 | A | * | 3/1989 | Fiedler et al. | 417/394 |
| 4,886,432 | A | * | 12/1989 | Kimberlin | 417/478 |
| 5,027,902 | A | | 7/1991 | Dickinson et al. | 166/369 |
| 5,058,669 | A | | 10/1991 | Wells | 166/107 |
| 5,147,182 | A | | 9/1992 | Timmons | 417/234 |
| 5,147,184 | A | | 9/1992 | Newcomer et al. | 417/394 |
| 5,147,185 | A | | 9/1992 | Niehaus et al. | 417/394 |
| RE34,754 | E | | 10/1994 | Dickinson et al. | 166/64 |
| 5,704,772 | A | | 1/1998 | Breslin | 417/478 |

OTHER PUBLICATIONS

Ground Water Issue, EPA, Low–Flow (Minimal Drawdown) Ground–Water Sampling Procedures (pp. 1–12).

* cited by examiner

*Primary Examiner*—Michael Koczo
(74) *Attorney, Agent, or Firm*—Liniak, Berenato, Longacre & White, LLC

(57) ABSTRACT

A liquid pump for pumping groundwater samples from small diameter sub-terrain wells. The pump comprises a tubular casing having swaged ends and provided with inlet apertures on its side wall, a top cap and a bottom cap each provided with a bladder mandrel, a coil spring biasing the caps, a flexible bladder separating the interior of the pump into a liquid chamber and a gas chamber, and a pair of poppet valves preventing backflow of the pumped liquid. The pump is actuated by alternately pressurizing and de-pressurizing the actuating gas, preferably air, in the gas chamber causing the bladder to alternately contract and relax. The bladder is formed with reduced diameter ends that allows for an increased stroke volume of the pump. The pump is operated by a precision dual range controller, specifically adapted for "low flow" sampling.

22 Claims, 5 Drawing Sheets

BLADDER PUMP FOR LIQUID SAMPLING AND COLLECTING

BACKGROUND OF THE INVENTION

1. Field of the Invention

The present invention relates generally to liquid pumping and collecting apparatuses, and more particularly to a system for pumping underground liquid, such as groundwater samples, from small diameter wells. It should be noted, however, that the invention is also applicable and adaptable in various other applications that will occur to one skilled in the art from the disclosure herein.

2. Description of the Prior Art

Recent increases in public concern for the environment have resulted in various government-imposed environmental regulations with regard to groundwater quality and land-site cleanup projects. Among such regulations are requirements relating to the monitoring and sampling of water quality of aquifers as sources of drinking water. In response to these requirements, water quality analytic capabilities have been improved and water-sampling equipment has been developed. However, presently most sampling using bladder pumps employs permanently installed dedicated pumps in monitoring wells. Current portable equipment for the groundwater sampling is relatively heavy, bulky, and thus difficult to transport from one monitoring site to another.

One of the preferred types of pumps for groundwater sampling or other pumping applications is a submersible, fluid-actuated pump wherein the actuating fluid is preferably a gas such as compressed air. A flexible bladder member in this type of pump separates and isolates the interior of the pump into two chambers: a liquid chamber that contains the sample fluid and is in communication with both the pump inlet and outlet, and a gas chamber surrounding the first chamber, and connected to a source of the actuating gas, with the bladder disposed therebetween. The pumped liquid is conveyed through the pump by alternately pressurizing and venting or relieving the pressure in the gas chamber to contract and relax the bladder member, thus alternately decreasing and increasing the volume of the liquid chamber. The pumped liquid is drawn into the liquid chamber during such increases in volume under the influence of the natural hydrostatic head of the groundwater or other pumped liquids and is discharged through the pump outlet during such decreases in volume, thereby conveying the pumped liquid through the pump.

The conventional bladder pumps employ ball-type check valves that control flow of liquid trough the pump. However, the ball-type check valves have proven to be not very efficient, especially in low-flow applications where the velocity with which water enters the pump intake is low. Ball members of the check valves are prone to roll around valve seats and, thus are slow to respond to the change of the water flow direction.

The need therefore exists for a liquid sampling bladder pump with more efficient check valves.

SUMMARY OF THE INVENTION

The present invention alleviates the drawbacks of the prior art. The present invention provides a pump for a wide variety of applications, including, but not limited to, groundwater quality applications, withdrawing and collecting contaminated groundwater or other subterranean liquids from a landfill-site having a plurality of in-ground wells. The novel pump may be built with a small outside diameter, such as ¾" or ⅞" and is adapted to sample temporarily and/or permanently installed small diameter monitoring wells. The bladder pump of the present invention is particularly effective for conducting "low-flow sampling" from monitoring wells where minimal purging is undertaken prior to sample collection. Please note that low-flow refers to the velocity with which water enters pump intake and that is imparted to the formation pore water in the immediate vicinity of the well screen.

The preferred liquid sampling pump is an air-operated, gas-displacement bladder pump having a generally hollow cylindrical body submersible in the in-ground well. The pump body includes a liquid inlet with an inlet cone-shaped check valve for allowing one-way fluid flow from the in-ground well into the housing interior, and a liquid outlet with a similar outlet cone-shaped check valve allowing one-way fluid flow from the pump body interior to the discharge collection equipment. The cone-shaped check valves provide better effectiveness than conventional ball-type check valves.

An exemplary control apparatus in some applications for supplying and controlling an operating fluid for a gas-displacement pump supplies pulses of a pressurized operating fluid, such as air, into the pump body interior in order to forcibly displace and discharge liquid material through the outlet. Between pressurized pulses of the operating fluid, the control apparatus relieves the pressure of the other operating fluid in the pump body interior in order to permit liquid material to flow, under the influence of its own hydrostatic head, into the pump housing through the inlet.

BRIEF DESCRIPTION OF THE DRAWINGS

Other objects and advantages of the invention will become apparent from a study of the following specification when viewed in light of the accompanying drawings, wherein.

DETAILED DESCRIPTION

Figure 1:
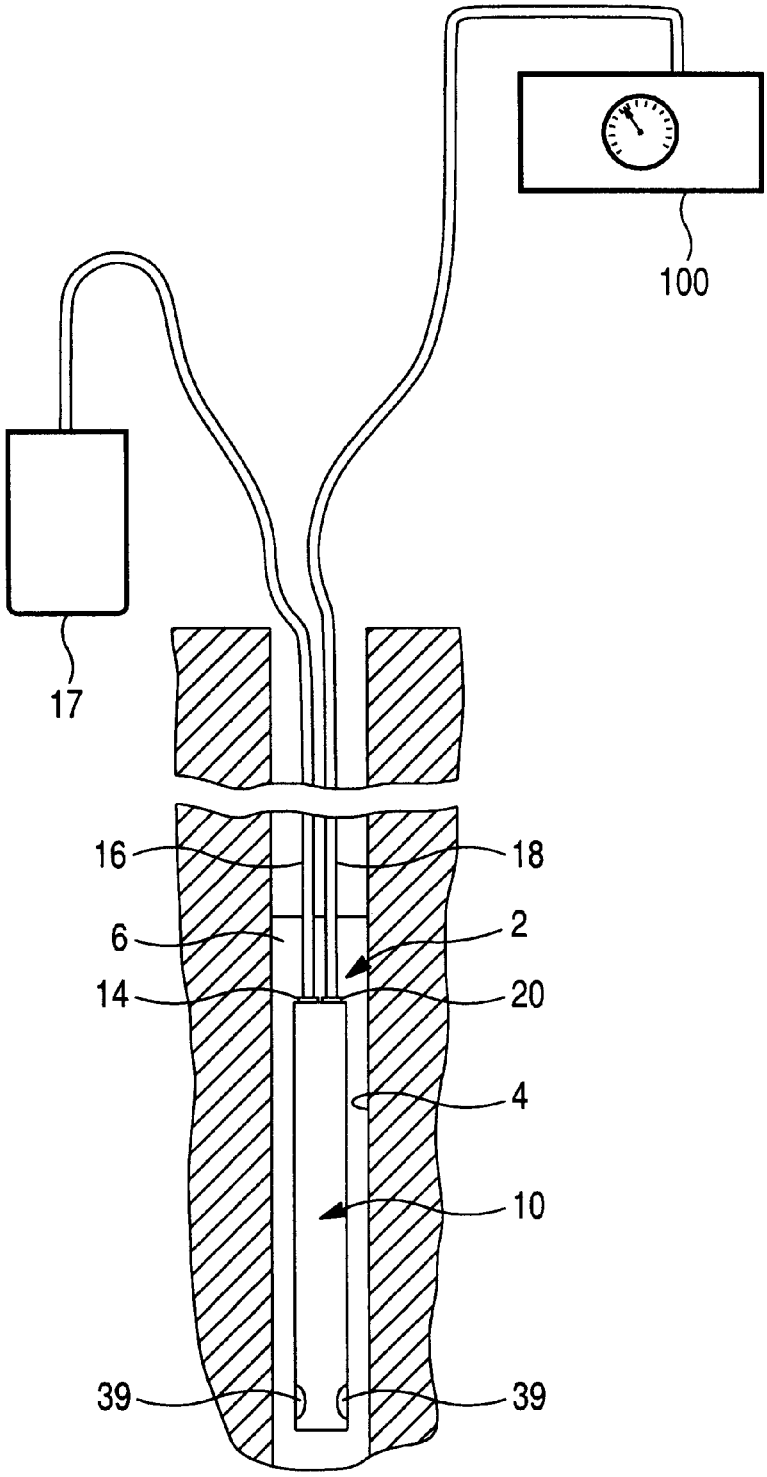
FIG. 1 is a fragmentary longitudinal sectional view of a liquid sampling system.

FIG. 1 of the drawings illustrates an underground liquid sampling system indicated generally by reference numeral 1. For purposes of illustration, the liquid sampling apparatus is shown as installed in a monitoring well 2. A fluid sampling pump 10 is disposed within the well casing 4 of the monitoring well 2 and is submerged beneath the level of the groundwater 6 to a suitable depth for obtaining representative groundwater samples.

As is explained in further detail below, the liquid sampling pump 10 in accordance with the present invention, is a bladder-type fluid-actuated pump, wherein the actuating fluid is a pressurized gas, preferably compressed air, and includes a plurality of inlet openings 39 and an outlet fitting 14.

A liquid conduit 16 is sealingly connected at one end to the pump outlet fitting 14 to provide direct sample delivery to a sample collection vessel 17. A pressurized gas conduit 18 is connected at one end to a fluid fitting 20 of the pump 10. The other end of the gas conduit 18 is selectively and removably connected to a precision dual range controller 100.

Because the pump is preferably of a lightweight construction, the conduits themselves can frequently be used to hold and retain the pump in its submerged position in the well 2. Preferably, the pump 10 is provided with an attachment device (not shown) that allows users to support the pump in the well with a covered steel cable. It will be appreciated that any other appropriate means for holding and retaining the pump 10 in its submerged position in the well 2, commonly known to those skilled in the art, may be used.

The precision dual range controller 100 is selectively and removably connected to the pump 10 by means of the external gas conduit 18. The preferred controller 100 is a portable, lightweight unit and includes means for alternately positively pressurizing and venting or relieving the pressure of the actuating gas in order to operate the liquid sampling pump 10, as is explained below.

Figure 2:
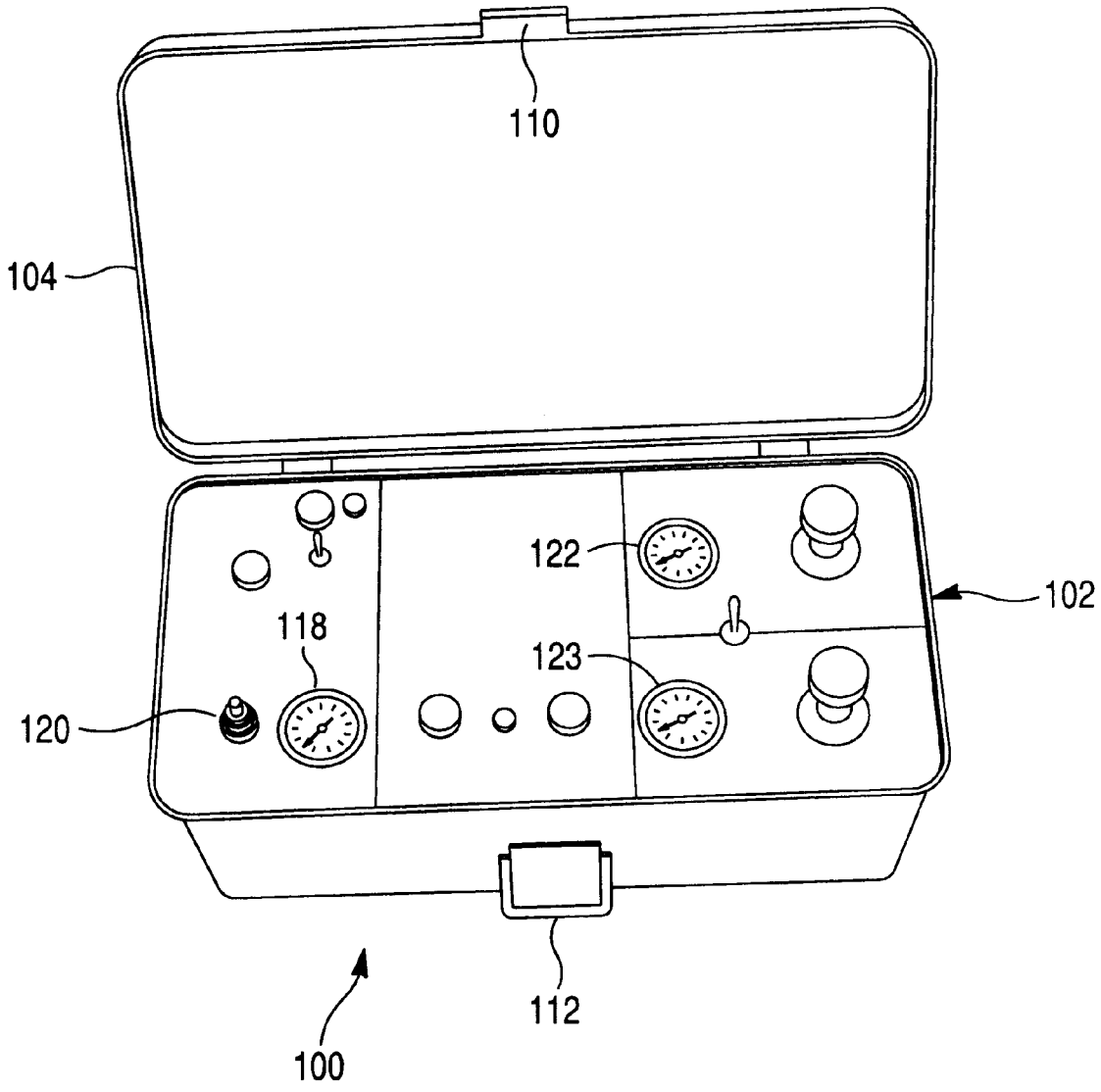
FIG. 2 is a perspective view of a controller apparatus of FIG. 1.

FIG. 2 illustrates a preferred physical arrangement for the dual range controller 100, including a carrying case 102 for housing and transporting the portable controller apparatus from one monitoring site to another. The carrying case 102 generally includes an upper portion 104 hingedly connected to a base portion 106, carrying handle (not shown), and upper and lower latches 110 and 112. The carrying case 102 is preferably composed of high impact-resistant materials known to those skilled in the art for purposes of protecting the components of the controller 100. The dual range controller generally includes two separate, switchable, pressure regulated air supply circuits, preferably 0–50 psi and 0–100 psi, each having a dedicated pressure gauge 122 and 123 respectively, a fitting 120 to which the external gas conduit may be connected, a pressure gauge 118 used to monitor the air supply provided to the controller 100, and various controls. To enable precision control of the flow from the bladder pump, the controller 100 is provided with separate precision electronic timers to control the flow air to and from the pump 10, each of which is adjustable in the range of 0.1 to 10 seconds. The carrying case 102 is especially adapted for ease and convenience of transportation of the controller and related components to monitoring sites to which access is limited or difficult.

The various individual components of the preferred controller apparatus 100 are well known to those skilled in the art and thus are described only schematically in terms of their functions.

Figure 3A:
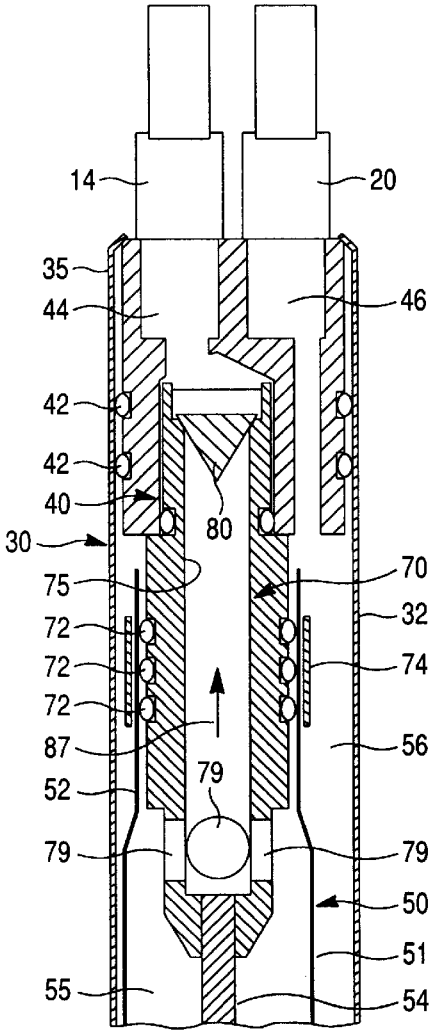
FIGS. 3*a* and 3*b* are fragmentary cross-sectional views of upper and lower portions, respectively, of a liquid pump in accordance with the first embodiment of the present invention.
Figure 3B:
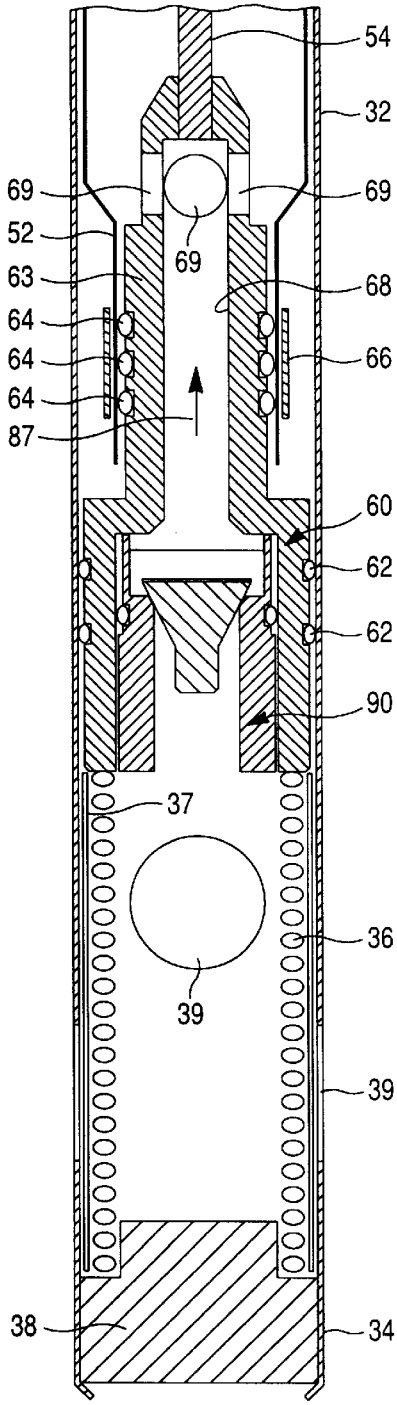

As illustrated in FIGS. 3*a* and 3*b*, the fluid sampling pump 10 in accordance with the first embodiment of present invention, includes a generally tubular pump casing 30 having a cylindrical wall 32, a lower end 34 and an upper end 35. The cylindrical wall 32 of the pump body 30 is swaged at the opposite lower and upper ends 34 and 35 thereof respectively. The lower end 34 of the pump body 30 is sealed with a bottom plug 38. The upper end of the pump body 30 is closed with a top cap 40. The casing 30 is swaged at its upper and lower ends to retain the bottom plug 38 and the top cap 40. The top cap 40 is sealed to an internal surface of the wall 32 by means of O-rings 42 or other suitable sealing means known to those skilled in the art.

A bottom cap 60 is provided between the bottom plug 38 and the top cap 40. The bottom cap 60 sealingly engages the wall 32 by means of O-rings 62. The bottom cap 60 is provided with a communication passage 68 therethrough. The bottom cap includes an integrally formed bottom bladder mandrel 63. However, a separate bottom bladder mandrel secured to the bottom cap by any appropriate means, is also within the scope of the present invention.

The interior of the pump body 30 is divided and isolated into two chambers by a generally cylindrical flexible bladder 50 having a central portion 51 and two opposite ends 52. The bladder 50 defines a liquid chamber 55 in its interior and an annular fluid chamber 56 between an exterior of the bladder 50 and an interior wall surface of the pump body 30. The bladder 50 is sealingly connected to a top bladder mandrel 70 at its upper end by means of O-rings 72 and a band clamp 74, and to the bottom bladder mandrel 63 at its lower end by means of O-rings 64 and a band clamp 66. The top bladder mandrel 70 is preferably threadedly attached to the top cap 40. The top bladder mandrel 70 and the bottom bladder mandrel 63 are interconnected by a support member 54. Preferably, the support member 54 is a solid rod. In this case, the top bladder mandrel 70 includes a number of apertures 79 providing the free flow of groundwater liquid between the liquid chamber 55 and the passage 75 in the bladder mandrel 70, and the bottom mandrel 63 includes a number of apertures 69 providing the free flow of groundwater liquid between the liquid chamber 55 and the passage 68.

However, the support member 54 may be in the form of a hollow tube provided with a number of apertures spaced at various locations along its longitudinal length in order to allow the free flow of groundwater fluid between the interior of the tube and the remainder of the liquid chamber 55. In this case, no apertures 69 and 79 are formed in the mandrels 63 and 70 correspondingly.

A spring member, preferably a coil spring 36, is disposed between the bottom plug 38 and the bottom cap 60 in order to bias the caps 40 and 60 toward the upper end of the pump casing 30.

As illustrated in FIGS. 3*a* and 3*b*, the bladder 50 is formed with the reduced diameter ends 52 relative to the central portion 51 thereof. This allows for an increased stroke volume and, therefore, increased efficiency of the pump operation.

Figure 4:
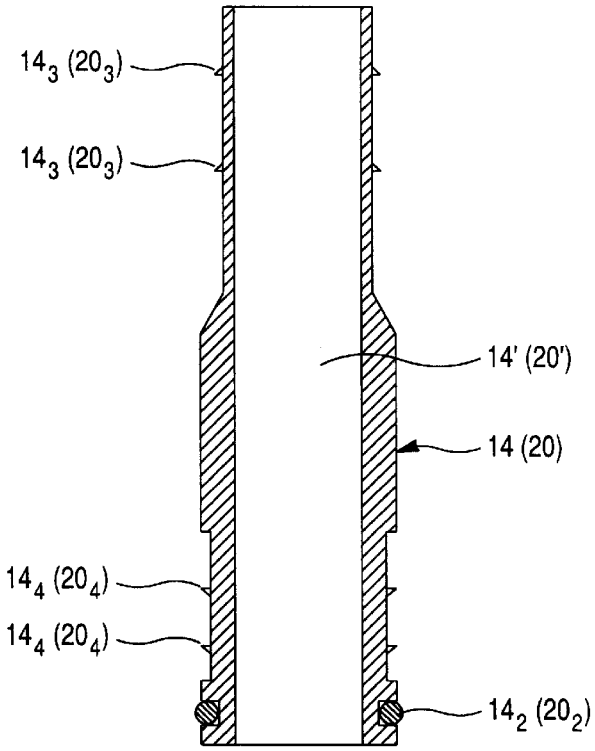
FIG. 4 is a cross-sectional view of a push-fit fitting.

The top cap 40 is provided with an outlet liquid port 44, and a fluid communication port 46. The outlet fitting 14 is affixed to the liquid outlet port 44. The actuating gas fitting 20 is affixed to the fluid communication port 46. The fittings 14 and 20 are identical and may be conventional threaded fittings or any other appropriate fittings well known in the prior art. Preferably, push-fit barb fittings, illustrated in FIG. 4, are employed. They include a bore 14'(20'), an O-ring seal $\mathbf{14}_2(\mathbf{20}_2)$ and two sets of barbs $\mathbf{14}_3(\mathbf{20}_3)$ and $\mathbf{14}_4(\mathbf{20}_4)$ for sealing and security.

In the preferred embodiment, the lower end 34 of the pump casing 30 is provided with a plurality of liquid inlet apertures 39 in the wall 32, located substantially between the bottom plug 38 and a bottom cap 60. Preferably, the inlet apertures 39 are located in close proximity to each other forming a limited sampling area. This allows the pump 10 to sample a narrow stratum of liquid in the monitoring well. A mesh screen filter 37, preferably, of stainless steel, is disposed within the casing 30 adjacent to the apertures 39 for filtering out solids greater than a predetermined size.

Figure 5:
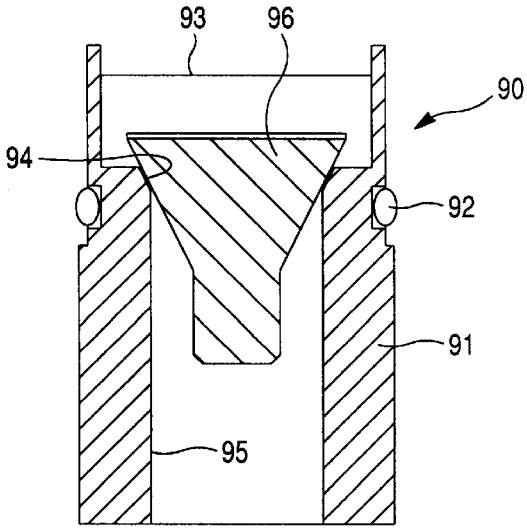
FIG. 5 is a fragmentary cross-sectional view of a cone-shaped check valve in accordance with the present invention.

Furthermore, the top bladder mandrel 70 includes a communication passage 75 therethrough. An outlet cone-shaped check valve 80 for preventing backflow of the pumped liquid through the passage 75 to the liquid chamber 55 from the outlet port 44 is provided in the top cap 40. Thus, when the pumped liquid, such as groundwater, is flowing through the pump in the direction indicated by flow arrows 87, the groundwater passes around the outlet cone-shaped check valve 80 and through the outlet port 44 and the outlet fitting 14. Backflow in the direction opposite that indicated by flow arrows 87, is substantially prevented by sealing engagement of the outlet cone-shaped check valve 80 with a corresponding valve seat on the bladder mandrel Correspondingly, an inlet cone-shaped check valve 90 for preventing backflow of groundwater or other pumped liquid through the inlet passage 68 and the inlet apertures 39 from the liquid chamber 55 is provided in the bottom cap 60. The inlet cone-shaped check valve 90, illustrated in detail in FIG. 5, comprises a housing 91 sealingly secured in the passage 68 by means of O-ring 92, and a cone 96 trapped between valve seat 94 and cone retainer 93. The housing 91 is provided with a communication port 95 selectively blocked and opened by the cone 96.

Thus, when the pumped liquid, such as groundwater, is flowing through the pump in the direction indicated by flow arrows 87 (shown in FIG. 3*b*), the groundwater passes around the cone 96 and the cone retainer 93 and through the passage 68 into the liquid chamber 55. Backflow in the direction opposite that indicated by flow arrows 87 is substantially prevented by sealing engagement on the cone 96 with the corresponding valve seat 94.

Referring to FIGS. 1, 3*a* and 3*b*, the preferred fluid sampling pump 10 is actuated by means of actuating gas supplied to the fluid chamber 56 which is alternately and sequentially subjected to positive and negative or reduced pressures. The alternate pressurizing and depressurizing of the actuating gas in the gas chamber 56 causes the bladder 50 to alternately expand and contract, thus alternately and sequentially decreasing and increasing the volume of the liquid chamber 55. During such increases in volume, the groundwater is drawn from the well 12 into the liquid chamber 55 through the inlet apertures 39 in the casing 30 and the passage 68 in the bottom cap 60. During such decreases in such volume, the groundwater is forced out of the liquid chamber 55 through the passage 75 in the top bladder mandrel 70 and the outlet port 44 in the top cap 40 and is passed through the outlet fitting 14 and the groundwater conduit 16 to be collected in the sample collection vessel 17. The cone-shaped check valves 80 and 90 prevent the water from being discharged through the inlet apertures or drawing in through the outlet port.

The capacity of the pump 10 may be changed in different versions of the pump by changing the diameter of the tubular pump casing 30, thereby changing the amount of water drawn in and forced out during the alternate contractions and relaxations of the flexible bladder 50. Preferably, the bladder pumps in accordance with the present invention, may be manufactured with the outside diameter ¾, ⅞ and 1" depending on the particular application. Theoretically, increasing the length of the pump wall 32 and correspondingly increasing the length of the bladder 50 would also increase the stroke volume. However, the longer pumps are subject to hang up in the non-plumb monitoring wells. For this reason, the bladder pumps for well monitoring ought to be designed as short as possible.

It should be noted that the various components of the pump 10, contacting the pumped liquid, are preferably composed of relatively lightweight and low-cost synthetic materials that will not be corroded when exposed to the groundwater and that will not otherwise affect the composition of the groundwater flowing through the pump. Examples of such materials include stainless steel, rigid polyvinyl chloride (PVC), DELRIN and polytetrafluoroethylene (PTFE) marketed under the DuPont Teflon® trademark. The flexible bladder is preferably composed of a flexible synthetic material that also will not corrode or affect the composition of groundwater flowing therethrough, such as Teflon®. The casing 30 of the pump is preferably made of stainless steel. One skilled in the art will readily recognize, however, that the various components of the fluid sampling apparatus may be composed of other suitable non-corrosive materials.

Figure 6A:
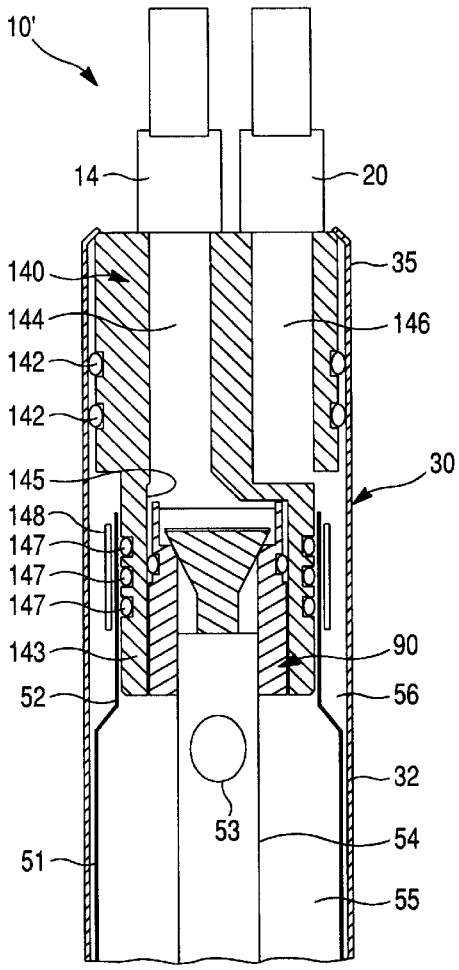
FIGS. 6*a* and 6*b* are fragmentary cross-sectional views of upper and lower portions, respectively, of a liquid pump in accordance with the second embodiment of the present invention.
Figure 6B:
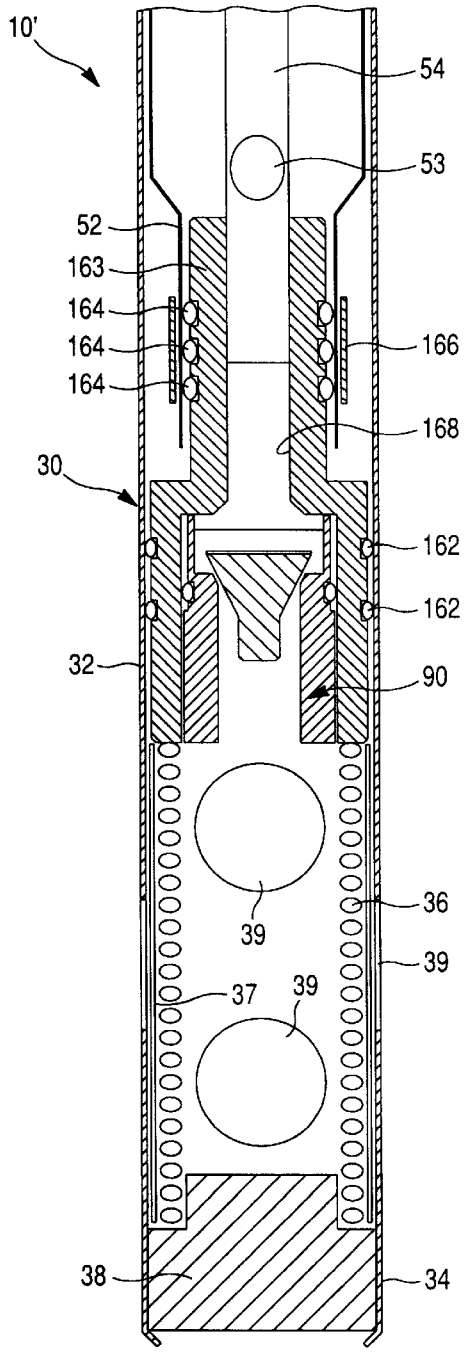

FIGS. 6*a* and 6*b* illustrates a liquid sampling pump 10' in accordance with the second embodiment of the present invention. With the reference to FIGS. 6*a* and 6*b*, the parts in common with FIGS. 3*a* and 3*b* are designated by the same reference numeral. The pump 10' includes a generally tubular pump casing 30 having a cylindrical wall 32, a lower end 34 and an upper end 35. The cylindrical wall 32 of the pump casing 30 is swaged at the opposite end 34 and 35 thereof. The lower end of the pump body 30 is sealed with a bottom plug 38. The upper end of the pump body 30 is closed with a top cap 140. The top cap 140 is formed integrally with a top bladder mandrel 143 provided with a communication passage 145. The casing 30 is swaged at its upper and lower ends to retain the bottom plug 38 and the top cap 140. The top cap 140 is sealed to an internal surface of the wall 32 by means of O-rings 142 or other suitable sealing means known to those skilled in the art.

A bottom cap 160 is provided between the bottom plug 38 and the top cap 140. The bottom cap 160 sealingly engages the wall 32 by means of O-rings 162. The bottom cap 160 is provided with an inlet liquid communication passage 168 therethrough. The bottom cap 160 is formed integrally with a bottom bladder mandrel 163. The top and bottom bladder mandrels 143 and 163 respectively are interconnected with a tubular support member 54.

A spring member, preferably a coil spring 36, is disposed between the bottom plug 38 and the bottom cap 160 in order to bias the caps 140 and 160 toward the upper end of the pump casing 30.

Furthermore, the lower end 34 of the pump casing 30 is provided with a plurality of liquid inlet apertures 39 in the wall 32, located substantially between the bottom plug 38 and the bottom cap 160. A mesh screen filter 37 is disposed within the casing 30 adjacent to the apertures 39 for filtering out solids greater than a predetermined size.

The interior of the pump body 30 is divided and isolated into two chambers by a generally cylindrical flexible bladder 50 having a central portion 51 and two opposite ends 52. The bladder 50 defines a liquid chamber 55 in its interior and an annular fluid chamber 56 between an exterior the bladder 50 and the interior wall surface of the pump body 30. The bladder 50 is sealingly connected to the top cap 140 and the bottom cap 160 at its opposite ends by means of O-rings 147 and 164 and band clamps 148 and 166 respectively. The tubular support member 54 is disposed within the liquid chamber 55 and includes a number of apertures 53 spaced at various locations along its longitudinal length in order to allow the free flow of groundwater fluid between the interior of the support member 54 and the remainder of the liquid chamber 55.

As illustrated in FIGS. 6*a* and 6*b*, the bladder 50 is formed with the reduced diameter ends 52 relative to the central portion thereof. This allows for an increased stroke volume and, therefore, increased efficiency of the pump operation.

The top cap 140 is provided with an outlet liquid port 144, and a fluid communication port 146. The outlet fitting 14 is affixed to the outlet liquid port 44. The actuating gas fitting 20 is affixed to the fluid communication port 146. The fittings 14 and 20 are identical and may be conventional threaded fittings or any other appropriate fittings well known in the prior art. Preferably, push-fit barb fittings, described in detail above and illustrated in FIG. 4, are employed.

Moreover, the bottom cap 160 includes a cone-shaped check valve 90 for preventing backflow of groundwater or other pumped liquid through the inlet passage 168 and the inlet apertures 39 from the liquid chamber 55. Similarly, the top cap 140 includes the cone-shaped check valve 90 for preventing backflow of groundwater or other pumped liquid from the outlet port 144 to the liquid chamber 55. The cone-shaped check valve 90 is described in detail above and illustrated in FIG. 5. The operation of the pump 10' is similar to the operation of the pump 10 described in hereinabove.

Therefore, the novel arrangement of the liquid sampling bladder pump of the present invention as constructed in the above-described embodiments provides simplified field application and easy deployment in non-plumb wells, and allows for obtaining representative samples of groundwater or other liquids.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiment disclosed hereinabove was chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A bladder-type fluid-actuated liquid pump adapted to be at least partially submerged in a liquid to be pumped, said pump comprising:

a hollow casing adapted to be immersed in the liquid, said casing having an upper end and a lower end;

a liquid inlet in said lower end;

a liquid outlet port in said upper end;

a fluid communication port in said upper end;

a fluid chamber inside said hollow casing for receiving a fluid under pressure therein, said fluid chamber being in fluid communication with said fluid communication port;

a liquid chamber inside said hollow casing for receiving the liquid therein, said liquid chamber being in fluid communication with said liquid inlet and said liquid outlet;

a flexible bladder separating said fluid chamber from said liquid chamber, said bladder being selectively deformable in response to changes in pressure of the fluid in order to cause the liquid to flow through said liquid chamber from said inlet to said outlet;

an inlet cone-shaped check valve between said liquid inlet and said liquid chamber for permitting one-way flow of the liquid therethrough from said inlet to said liquid chamber and for preventing back-flow of the liquid from said liquid chamber to said liquid inlet;

an outlet cone-shaped check valve between said liquid outlet and said liquid chamber for permitting one-way flow of the liquid therethrough from said liquid chamber to said outlet and for preventing back-flow of the liquid from said outlet to said liquid chamber;

a top cap disposed at the upper end of said casing, said top cap including said fluid port fluidly connected to said fluid chamber and said liquid outlet port;

a top bladder mandrel secured to said top cap, said top bladder mandrel having a communication passage therethrough for fluidly connecting said liquid chamber to said liquid outlet port in said top cap;

a bottom cap disposed at the lower end of said casing, said bottom cap having an inlet liquid passage fluidly connected to said liquid inlet;

a bottom bladder mandrel secured to said bottom cap, said bottom bladder mandrel having a communication passage therethrough for fluidly connecting said liquid chamber to said inlet liquid passage in said bottom cap, and a support member extending between said top and bottom mandrel inside said bladder, wherein said bladder being sealingly secured to said top bladder mandrel at one end and to said bottom bladder mandrel at the other end, and wherein said liquid chamber is enclosed within said flexible bladder.

2. The bladder-type fluid-actuated liquid pump as defined in claim 1, wherein said liquid inlet includes at least one intake opening formed in said hollow casing.

3. The bladder-type fluid-actuated liquid pump as defined in claim 2, further including a screen filter disposed adjacent to said intake opening to filter the liquid flowing therethrough.

4. The bladder-type fluid-actuated liquid pump as defined in claim 1, wherein said bladder having a central portion and opposite ends, and said central portion having a larger diameter than said ends.

5. The bladder-type fluid-actuated liquid pump as defined in claim 1, wherein said inlet cone-shaped check valve is disposed in said bottom cap, and said outlet cone-shaped check valve is disposed in said top cap.

6. The bladder-type fluid-actuated liquid pump as defined in claim 1, wherein at least one of said top and bottom mandrels being integrally formed with said corresponding top and bottom caps as a one-piece part.

7. The bladder-type fluid-actuated liquid pump as defined in claim 1, wherein said top and bottom mandrels being integrally formed with said corresponding top and bottom caps as one-piece parts.

8. The bladder-type fluid-actuated liquid pump as defined in claim 1, wherein at least one of said top and bottom mandrels being threadedly secured to said corresponding top and bottom caps.

9. The bladder-type fluid-actuated liquid pump as defined in claim 1, wherein said support member being a solid rod and each of said top and bottom mandrels being provided with at least one aperture in order to allow flow of the liquid between said communication passages in said mandrels and said liquid chamber.

10. The bladder-type fluid-actuated liquid pump as defined in claim 1, wherein said support member being a hollow tube having a plurality of spaced apertures in order to allow flow of the liquid between an interior of said tube and said liquid chamber.

11. The bladder-type fluid-actuated liquid pump as defined in claim 1, further including a bias member disposed within said casing for biasing said bottom cap toward the upper end of said casing.

12. The bladder-type fluid-actuated liquid pump as defined in claim 11, wherein said bias member is a coil spring.

13. The bladder-type fluid-actuated liquid pump as defined in claim 1, wherein said hollow casing being a cylinder.

14. The bladder-type fluid-actuated liquid pump as defined in claim 1, wherein said hollow casing being made of stainless steel.

15. The bladder-type fluid-actuated liquid pump as defined in claim 1, wherein said flexible bladder being made of polytetrafluoroethylene.

16. A bladder-type fluid-actuated liquid pump adapted to be at least partially submerged in a liquid to be pumped, said pump comprising:

a hollow casing adapted to be immersed in the liquid, said casing having an upper end and a lower end;

a liquid inlet in said lower end;

a liquid outlet port in said upper end;

a fluid communication port in said upper end;

a fluid chamber inside said hollow casing for receiving a fluid under pressure therein, said fluid chamber being in fluid communication with said fluid communication port;

a liquid chamber inside said hollow casing for receiving the liquid therein, said liquid chamber being in fluid communication with said liquid inlet and said liquid outlet;

a flexible bladder separating said fluid chamber from said liquid chamber, said bladder being selectively deformable in response to changes in pressure of the fluid in order to cause the liquid to flow through said liquid chamber from said inlet to said outlet;

an inlet cone-shaped check valve between said liquid inlet and said liquid chamber for permitting one-way flow of the liquid therethrough from said inlet to said liquid chamber and for preventing back-flow of the liquid from said liquid chamber to said liquid inlet;

an outlet cone-shaped check valve between said liquid outlet and said liquid chamber for permitting one-way flow of the liquid therethrough from said liquid chamber to said outlet and for preventing back-flow of the liquid from said outlet to said liquid chamber;

a top cap disposed at the upper end of said casing, said top cap including a fluid port fluidly connected to said fluid chamber and said liquid outlet port fluidly connected to said liquid chamber;

a bottom cap disposed at the lower end of said casing, said bottom cap having an inlet liquid passage fluidly connecting said liquid inlet to said liquid chamber, and a support member extending between said upper and lower caps inside said bladder, wherein said bladder being secured to said top cap at one end and to said bottom cap at the other end, and wherein said liquid chamber is enclosed within said flexible bladder.

17. The bladder-type fluid-actuated liquid pump as defined in claim 16, wherein said inlet cone-shaped check valve is disposed in said bottom cap, and said outlet cone-shaped check valve is disposed in said top cap.

18. The bladder-type fluid-actuated liquid pump as defined in claim 16, wherein said support member is a hollow tube having a plurality of spaced apertures in order to allow flow of the liquid between an interior of said tube and said liquid chamber.

19. The bladder-type fluid-actuated liquid pump as defined in claim 16, further including a bias member disposed within said casing for biasing said bottom cap toward the second end of said casing.

20. The bladder-type fluid-actuated liquid pump as defined in claim 19, wherein said bias member is a coil spring.

21. A bladder-type fluid-actuated liquid pump adapted to be at least partially submerged in a liquid to be pumped, said pump comprising:

a tubular casing having a rigid wall, a lower end and an upper end;

a liquid inlet disposed at the lower end of said casing;

a screen filter disposed adjacent to said liquid inlet to filter the liquid flowing therethrough;

a bottom plug closing said casing at the lower end thereof;

a top cap closing said casing at the upper end thereof, said top cap including a liquid outlet port and a fluid communication port, said top cap sealingly engaging said wall of said casing;

a top bladder mandrel secured to said top cap, said mandrel having a communication passage therethrough for fluidly communicating with said liquid outlet port;

a bottom cap sealingly engaging said wall of said casing between the lower end and the upper end thereof, said bottom cap having an integral bottom bladder mandrel having a communication passage therethrough;

a support rod extending between said top and said bottom bladder mandrels;

a flexible bladder sealingly secured to said top bladder mandrel at one end and to said bottom bladder mandrel at the other end thereof, said ends of said bladder having smaller diameter than a central portion of said bladder, said bladder defining a liquid chamber therewithin, said bladder being selectively deformable in response to changes in pressure of the actuating fluid in order to cause the liquid to flow through said liquid chamber from said inlet to said outlet;

a fluid chamber formed between said bladder and said wall of said casing;

said outlet liquid port formed in said top cap being fluidly connected said liquid chamber through said opening in said top mandrel;

said fluid communication port formed in said top cap being fluidly connected to said fluid chamber;

said communication passage formed in said bottom bladder mandrel fluidly connecting said liquid inlet to said liquid chamber;

an inlet cone-shaped check valve disposed in said bottom cap for permitting one-way flow of the liquid therethrough from said inlet to said liquid chamber and for preventing backflow of the liquid from said liquid chamber to said liquid inlet;

an outlet cone-shaped check valve disposed in said top mandrel for permitting one-way flow of the liquid from said liquid chamber to said outlet liquid port and for preventing backflow of the liquid from said outlet liquid port to said liquid chamber, and a bias member disposed within said tubular casing between said bottom plug and said bottom cap for biasing said bottom end toward said upper end of said casing.

22. A bladder-type fluid-actuated liquid pump adapted to be at least partially submerged in a liquid to be pumped, said pump comprising:

a tubular casing having a rigid wall, a lower end and an upper end;

a liquid inlet disposed at the lower end of said casing;

a screen filter disposed adjacent to said liquid inlet to filter the liquid flowing therethrough;

a bottom plug closing said casing at the lower end thereof;

a top cap closing said casing at the upper end thereof, said top cap including a liquid outlet port and a fluid communication port, said top cap sealingly engaging said wall of said casing;

a top bladder mandrel integrally formed with said top cap, said top mandrel having a communication passage fluidly connected to said liquid outlet port;

a bottom cap sealingly engaging said wall of said casing between the lower end and the upper end thereof, said bottom cap being provided with a communication passage therethrough;

a bottom bladder mandrel integrally formed with said bottom cap;

a perforated support tube extending from said top mandrel to said bottom mandrel;

a flexible bladder disposed about said support tube and secured to said top mandrel at one end and to said bottom mandrel at the other end thereof, said ends of said bladder having smaller diameter than a central portion of said bladder, said bladder defining a liquid chamber therewithin, said bladder being selectively deformable in response to changes in a pressure of the actuating fluid in order to cause the liquid to flow through said liquid chamber from said inlet to said outlet;

a fluid chamber formed between said bladder and said wall of said casing;

said outlet liquid port formed in said top cap being fluidly connected said liquid chamber through said opening in said top mandrel;

said fluid communication port formed in said top cap being fluidly connected to said fluid chamber;

said communication passage formed in said bottom cap fluidly connecting said liquid inlet to said liquid chamber;

an inlet cone-shaped check valve disposed in said bottom cap for permitting one-way flow of the liquid therethrough from said inlet to said liquid chamber and for preventing backflow of the liquid from said liquid chamber to said liquid inlet;

an outlet cone-shaped check valve disposed in said top cap for permitting one-way flow of the liquid therethrough from said liquid chamber to said outlet liquid port and for preventing back-flow of the liquid from said outlet liquid port to said liquid chamber, and a bias member disposed within said tubular casing between said bottom plug and said bottom cap for biasing said bottom end toward said upper end of said casing.

* * * * *